United States Patent [19]

O'Grady

[11] Patent Number: 4,810,205

[45] Date of Patent: Mar. 7, 1989

[54] ELECTRICAL CONNECTOR WITH SECONDARY WEDGE LOCK

[75] Inventor: Thomas R. O'Grady, Ft. Wayne, Ind.

[73] Assignee: United Technologies Automotive, Inc., Dearborn, Mich.

[21] Appl. No.: 107,816

[22] Filed: Oct. 13, 1987

[51] Int. Cl.[4] ..... H01R 13/631

[52] U.S. Cl. ..... 439/350

[58] Field of Search ..... 439/271–275, 439/350–355, 357–358, 347, 595–596, 603, 744

[56] References Cited

U.S. PATENT DOCUMENTS

| | | | |
|---|---|---|---|
| 3,434,098 | 3/1969 | Schumacher | 439/358 |
| 3,544,951 | 12/1970 | Roberts | 339/91 |
| 4,225,206 | 9/1980 | Roman, Jr. | 339/91 R |
| 4,272,145 | 6/1981 | LaDuke | 339/91 R |
| 4,398,073 | 8/1983 | Botz et al. | 339/91 |
| 4,431,244 | 2/1984 | Anhalt et al. | 439/358 |
| 4,557,542 | 12/1985 | Coller et al. | 439/595 |
| 4,565,416 | 1/1986 | Rudy et al. | 439/595 |
| 4,714,437 | 12/1987 | Dyki | 439/595 |

*Primary Examiner*—Joseph H. McGlynn

[57] ABSTRACT

An electrical connector including a basic connector shell having two female terminal receptacles inserted through one end and being lockingly engaged with the interior of the connector shell by means of tabs from the shell interior extending into mating openings in the terminal receptacles, with a secondary locking wedge member inserted through the opposite end of the shell, causing the tab-opening locking engagements to be further locked together by compressive, wedging forces directed towards the central interior of the shell. The secondary locking member at its top has two side, flexible legs having laterally extending locking protrusions which engage into mating cavities in the side, interior of the shell, effectively locking the secondary locking member into the shell. The wedge locking member and its interfacing with the interior structure of the shell forms an interior rectangular structure over which is placed a compressive sealing gasket. The rearmost structure of the secondary locking member forms in configuration a "T" which mates with two, opposed "L" shaped corner members on the interior of the shell, two laterally spaced openings being formed thereby for the insertion of the male electrical connectors to engage with the female terminal receptacles. Two integrally formed latching arms and pairs of flanking, protective, side flanges are provided on the exterior of the shell.

13 Claims, 5 Drawing Sheets

FIG. 5A
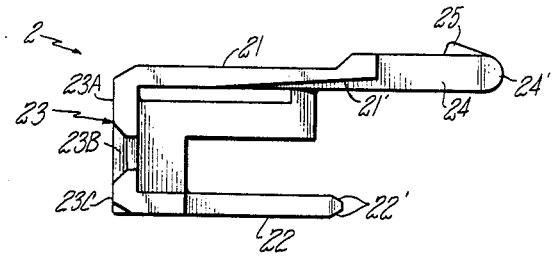
FIG. 5B
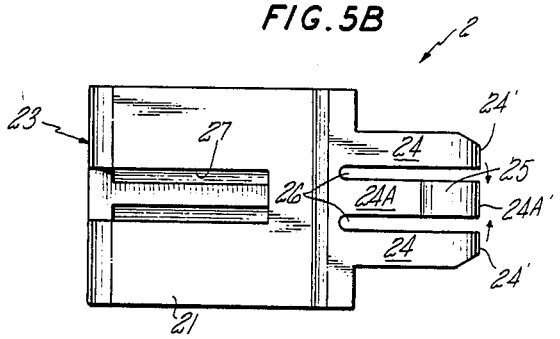
FIG. 6A
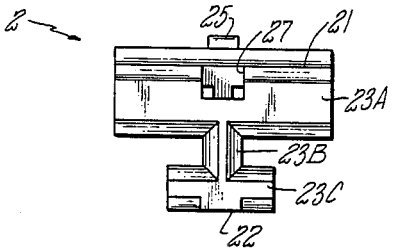
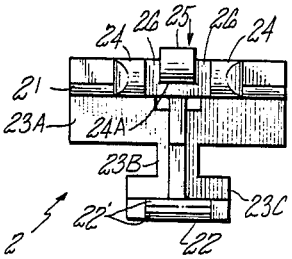
FIG. 6B

FIG. 7A
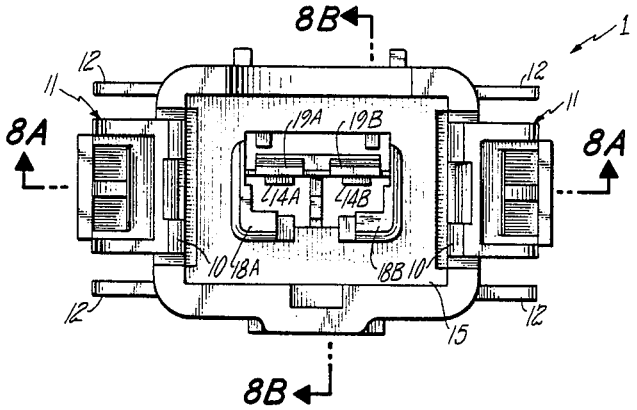
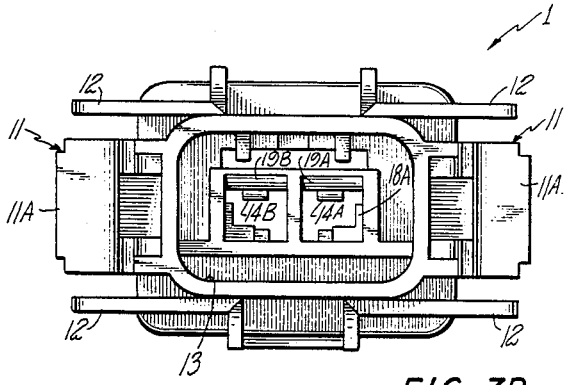
FIG. 7B
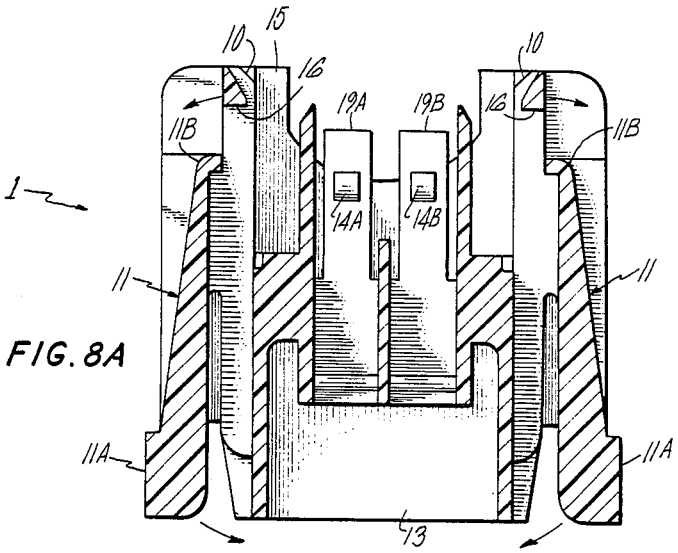
FIG. 8A

FIG. 8B
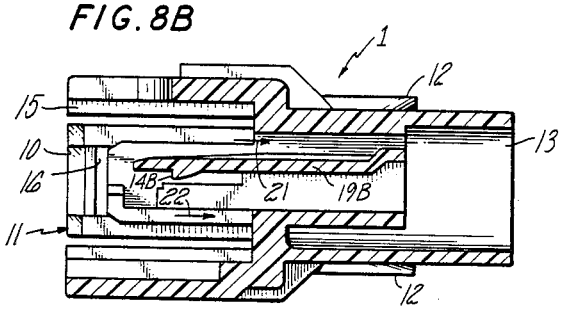
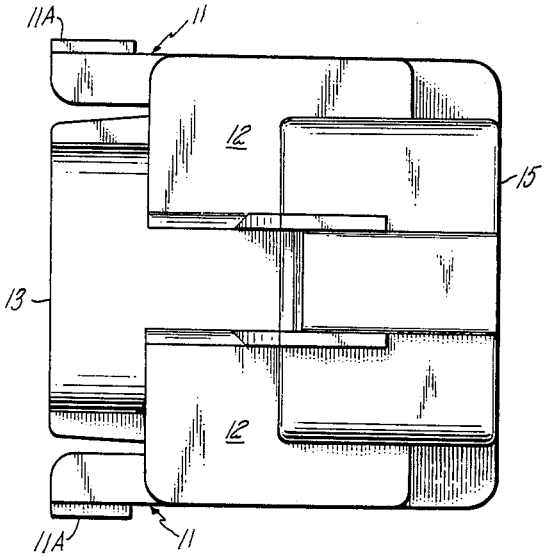
FIG. 9
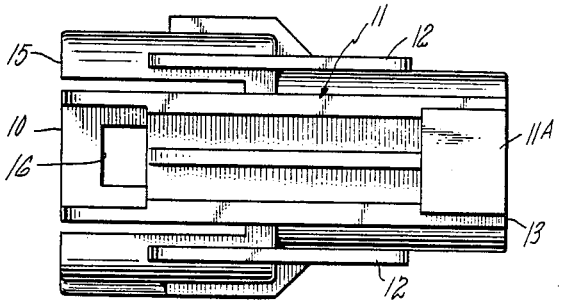
FIG. 10

ELECTRICAL CONNECTOR WITH SECONDARY WEDGE LOCK

TECHNICAL FIELD

The present invention relates generally to electrical connectors and more particularly to electrical connectors which include a relatively hard plastic outer casing which is slid over a mating connector element, particularly one for the electrical connection to a fuel injector in an automotive engine environment. The present invention more particularly relates to a secondary wedge lock element added to the electrical connector to further ensure the maintenance of the standard tab mechanical interlocking of the female terminal receptacle to the outer connector casing. Additionally, the present invention is directed to improvements in the design, placement and protection of the integral latching arms provided on the sides of the outer connector casing.

BACKGROUND OF THE INVENTION

Electrical connectors for making electrical connection between insulated conductor wires terminating in female receptacles and the male terminals of, for example, an electromagnetic fuel injector are known. Such a system is shown in U.S. Pat. No. 4,225,206 (issued to Michael J. Roman, Jr. on Sept. 30, 1980 assigned to General Motors Corporation). As shown in this '206 patent, each female terminal receptacle is lockingly engaged to the basic electrical connector body by means of, for example, a struck out lock tab cooperatively interfacing with internal shoulders in cavities formed in the interior of the basic connector body. This locking interface ideally prevents the female terminal from becoming disengaged and pulled out of position by, for example, tension on the connected conductor wire.

However, it happens too often that such a locking interface fails, allowing the female terminal to be pulled out of alignment with its intended interface with the male connector on the fuel injector, or perhaps even to be fully pulled out of the connector body. In recognition of this problem Roman provided a secondary locking flap Which engages seal sleeves on the conductor wires rearwardly of the female receptacles.

A first aspect of the present invention is to provide a secondary, wedge lock member preferably inserted into the front end of the connector body after the female terminal(s) is/are inserted into the basic connector body and initially locked into place by the tab or other projecting interface between the two. The secondary wedge lock of the present invention with centrally or radially directed compressive force provides greater mechanical integrity in the interlocking interface, preventing the primary locking interface from becoming inadvertently disengaged.

With respect to a second aspect of the present invention, such electrical connectors sometimes include a pair of opposed latching arms on the sides of the basic connector body for lockingly engaging cooperative lateral extensions on the device to which the connection is being made. The latching arms allow for ease in disengaging and unlocking the basic connector body from the device, when the latching arms are depressed. In this respect, in addition to the '206 patent, U.S. Pat. No. 4,272,145 to Jack E. LaDuke (issued June 9, 1981 assigned to Ford Motor Company), is noted, in which a single, integral, lever arm is included on one side of the basic connector body for interfacing with a cooperative projection on the device involved. Additional reference is made to U.S. Pat. No. 3,544,951 of J. Roberts (issued Dec. 1, 1970) which discloses a separate metal member placed around the basic connector body, which member includes two, opposed, metal latching arms.

However, a problem with all of these exemplary prior art approaches is that the latching arms are exposed and can be easily, inadvertently contacted, causing undesired disengagement of the connector from the device to which it was connected. Thus, a further aspect of the present invention is to provide protection for the latching arms, diminishing, if not preventing, inadvertent disengagement of the latching arms.

DISCLOSURE OF THE INVENTION

The present invention thus provides a secondary wedge lock member which further secures the integrity and maintenance of the primary locking interface between the female terminal receptacle(s) and the interior of the main connector body, with the secondary wedge lock member being inserted into the front end of the connector after the female terminal(s) have been inserted into the connector body and initially interlocked thereto. Such secondary wedge lock with centrally or radially directed, compressive force greatly enhances the fixity between the female terminal receptacle(s) and the basic connector body, preventing them from being inadvertently pulled out of the connector body or otherwise being misaligned due, for example, to pulling pressure on the conductor wire(s) attached to the female terminal receptacle(s).

In the particular embodiment disclosed as a preferred embodiment, the basic connector body or shell includes at its rear a wire sealing grommet through which the female terminal receptacles, usually two, are inserted through the rear of the connector shell.

The preferred embodiment of the secondary wedge lock includes a laterally and longitudinally extended upper surface, the bottom or underside of which contacts and bears down against the upper side of the internal leg portions of the connector shell, which interlock through bottom tabs with mating openings in the female terminal receptacle(s). The secondary wedge lock prevents the interlocking mechanical interconnection between the interior of the connector shell and the terminal receptacles(s) from becoming vertically disengaged, further locking the two together.

In order to effectively interlock the secondary wedge lock into the interior of the connector shell, laterally spaced, flexible legs, with laterally extending, terminal protrusions thereon are provided on the proximal interfacing ends of the secondary wedge lock for becoming engaged with mating female cavities in the interior sides of the connector shell.

In order to enhance the wedging action of the secondary lock, the secondary lock also includes on its bottom side a longitudinal extension, which forms with tee top side of the secondary lock a basic "C" configuration when viewed from the side. Additionally, when viewed from the rear, the back side of the locking wedge member forms a "T" which interfaces with opposed mating "L" sections on the interior of the shell, the combination defining the two, laterally spaced openings to the female receptacles for the male leads of the device to which the wires are being connected.

Thus, when fully assembled, the basic connector body or shell, the female terminal receptacle(s) and the secondary wedge lock are all securely interlocked together. Additionally, a gasket seal preferably is placed in the shell interior compressively encircling the rectangular wedge lock and shell interior interface. Further, supplemental, compressive force is provided by the telescopically inserted, surrounding structure of the male lead device. Thus, the integrity of the primary interlocking structure between the female receptacle(s) and the connector shell is thereby greatly enhanced, with the reliability of the interconnection substantially improved.

As previously mentioned, a further aspect of the present invention is to provide protection for the latching arm(s) on the exterior of the connector shell. In the preferred embodiment, such protection is provided by a flanking pair of opposed flanges extending out from the connector shell on the sides of each of the latching arm(s), protecting the latching arm(s) from being inadvertently struck by, for example, a side blow. However, when the latching arm(s) are to be engaged to unlock the connector shell from the device to which it is connected, the latching arm(s) are still readily accessible to the fingers, when the user desires to engage them.

Thus, again the integrity of the connections involving the connector is substantially enhanced, in this latter aspect enhancing the reliability of the interconnection between the connector and the device to which it is being connected, for example, the male leads for an electromagnetic fuel injector.

The foregoing and other features and advantages of the present invention will become more apparent from the following description and drawings.

BRIEF DESCRIPTION OF THE DRAWINGS

FIG. 2 is an end view of the fully assembled connector of FIG. 1, taken from the end that is to be interfaced with the male leads of the fuel injector; while FIG. 3 is a side, cross sectional view of the fully assembled connector, taken along cross sectional lines 3—3 of FIG. 2; while

FIGS. 5A and 5B are side and top views, respectively, of the secondary wedge lock member of the connector of FIG. 1; while FIGS. 6A and 6B are rear-exterior-end and front-interior-end views, respectively, of the secondary wedge lock member of FIGS. 5A and 5B.

FIGS. 7A and 7B are front and rear end views, respectively, of the connector body or shell by itself; while FIGS. 8A and 8B are cross sectional views taken through cross sectional lines 8A-8A and 8B-8B, respectively, of FIG. 7A; and FIGS. 9 and 10 are bottom and left side views, respectively, of the connector body or shell by itself.

BEST, EXEMPLARY MODE FOR CARRYING OUT THE INVENTION

Figure 1:
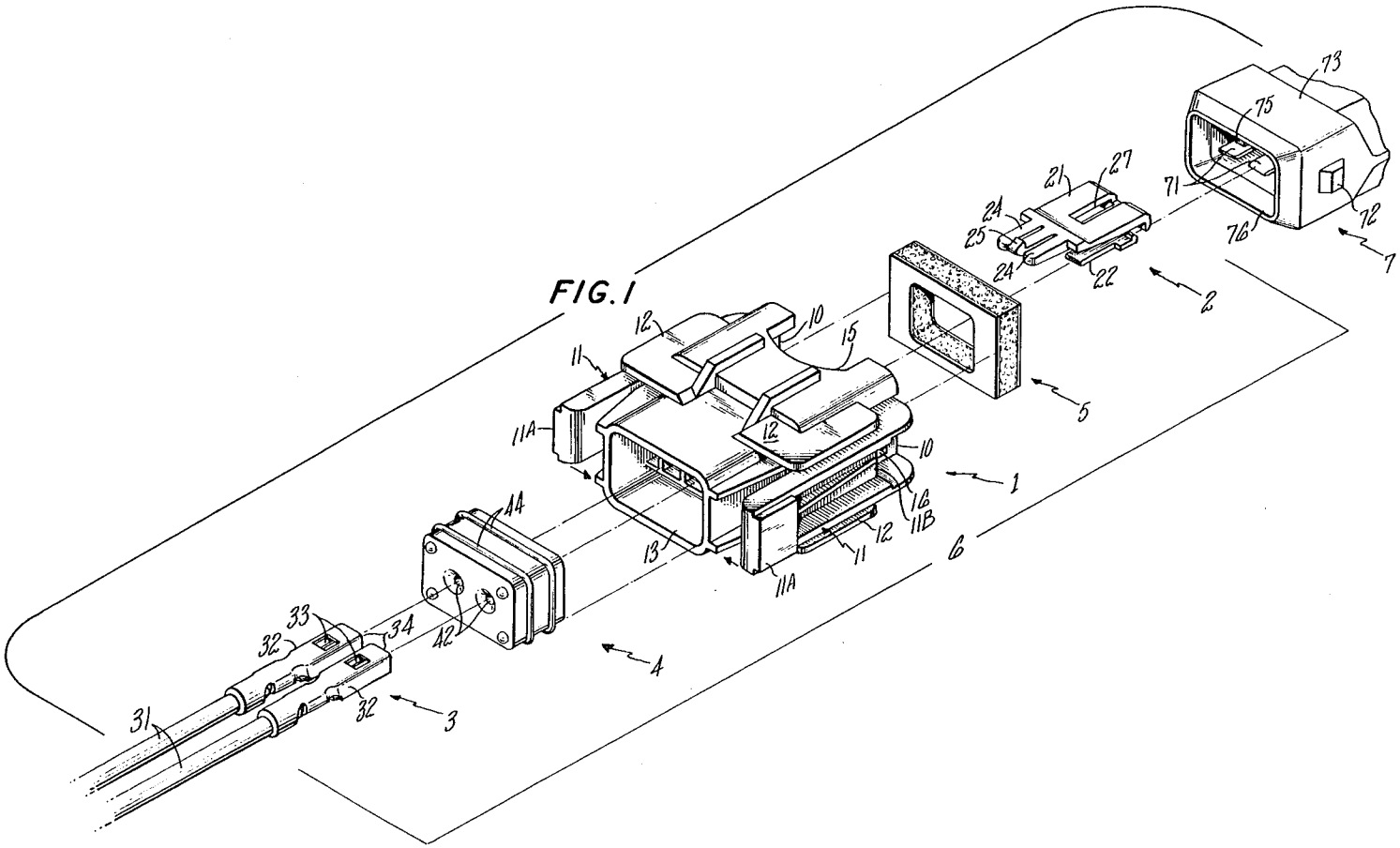
FIG. 1 is a perspective, top, exploded view of the overall elements of the connector and a partial view of the fuel injector showing the electrical male leads to which the female receptacles of the connector are to be mated.

As can be seen best in FIG. 1, the components of the complete electrical connector 6 include a connector shell or basic body 1, a rear wire sealing grommet 4 having two circular openings 42 therein, into which are inserted the female terminal receptacles 3 for the conductor wires 31, a secondary wedge lock member 2 and a front, compressible gasket seal 5. The electrical connector 6 is used to connect the conductor wires 31 to, for example, the male leads 71 of the electromagnetic fuel injector 7, onto and over which the connector shell 1 is slid in telescopic fashion.

Two lateral protrusions 72 (only one being viewable in the illustration) are included on the sides of the fuel injector interface 7, which protrusions 72 interlock into cooperative openings 16 located in the sides of the connector shell 1. As will be explained more fully below, latching arms 11 are used to unlatch and unlock the connector 6 from the fuel injector 7, allowing the protrusion 72 to be easily disengaged from the side openings 16 of the connector shell 1.

In assembling the connector components 1-5 of FIG. 1 together to form the overall electrical connector 6, the female terminal receptacles 3 are inserted through the sealing grommet 4 into the rear opening 13 of the connector shell 1. This longitudinal insertion continues until the female terminal receptacles 3 are seated within the connector shell 1 and projecting tabs 14A, 14B (see FIG. 3) interface with and extend into the mating, comparably configured locking openings 33 of the heads 32 of the corresponding female terminal receptacles 3, initially locking the terminals 3 to the interior of the shell 1. It is noted that the projecting tabs 14A, 14B extend down from the undersurfaces of the longitudinally, frontal extending legs 19A, 19B, which move or flex up as the heads 32 of female receptacles 3 are being inserted, until the tabs 14A, 14B pop into the open areas of the openings 33.

The rear grommet seal 4 is then slid up over the wires 31 and inserted into the rear 13 of the shell, if it had not already been previously inserted into the rear of the shell, sealing it off at the rear by means of the peripheral sealing edges 44 and the encircling sealing interfaces with the wires 31 at the openings 42. The conductor wires 31 thus extend out from the rear end of the terminal heads 32 and through the openings 42 of the rear grommet seal 4 for connection to the electrical power system of the vehicle and the fuel injector controls.

The secondary wedge lock member 2 is then inserted into the front end 15 of the connector shell 1, further locking the protruding tabs 14A, 14B into the terminal locking openings 33 in a compressive, wedging action, as explained more fully below.

Thereafter, the face seal or front gasket 5 is also inserted into the front end 15 of the connector shell 1, providing in cooperation with the rear grommet 4 a sealed connector body, allowing the connector 6 to have submersible characteristics. Additionally, the front sealing gasket 5 adds further compressive force to the tab/opening interlock 14/33 in its compressive encircling and holding of the secondary wedge lock 2 and its shell interior interface.

Figure 2:
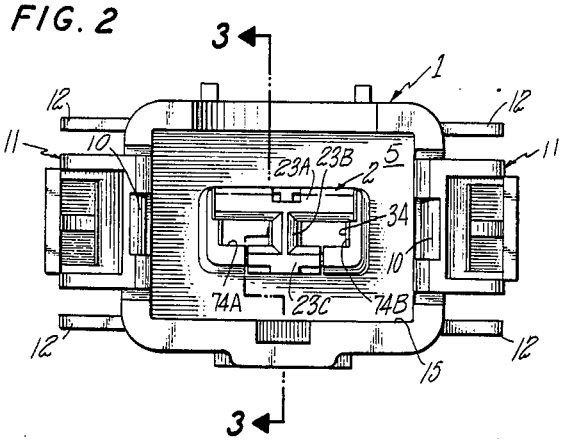

Once fully assembled, the connector 6 can then be engaged with the fuel injector 7 by sliding the front end 15 of the connector shell 1 over the exterior of the basic body 73 of the fuel injector interface 7, causing the male electrical contacts or leads 71 to become inserted into the corresponding female openings 34 in the female terminal receptacles 3 (note also FIG. 2). This causes the male contacts 71 to become electrically interconnected into the electrical power system of the vehicle and its electrical fuel injector controls.

When the encircling, surrounding structure 76 of the fuel injector interface is telescopically inserted into the front interior 15 of the connector body 1, it also generates radially or centrally directed, compressive forces on the internal secondary locking member 2 and the interfacing structure of the shell interior. A centrally located positioning extension 75 on the fuel injector interface 7 extends into a slot 27 formed in the top 21 of the locking wedge 2 (note FIGS. 5B and 6A), further frictionally "locking" everything together.

In inserting the connector 6 onto the fuel injector 7, the latching arms 11 are depressed by placing pressure on the distal ends 11A thereof, causing the side front edges 10 of the shell 1 to be moved outwardly (note directional arrows in FIGS. 1 and 8A). This allows the protrusions 72 on the fuel injector 7 to easily slide into the locking openings 16 in the sides of the connector shell 1 located adjacent to and forward of the proximal ends 11B of the latching arms 11. If desired, and as illustrated, extended surface pads can be provided at the exterior, distal ends 11A of the latch arms 11 to provide a more comfortable surface for the user's fingers.

Figure 4:
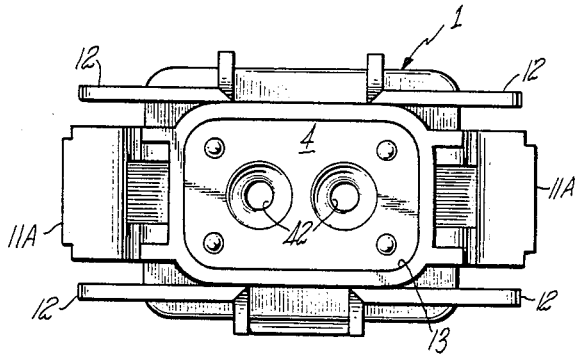
FIG. 4 is an end view of the other, rear end of the fully assembled connector of FIG. 1, but with the conductor wires not illustrated for clarity purposes.

With reference particularly to FIGS. 1, 2, 4, 9 and 10, it should be noted that rigid protective flanges 12 extend out from the side, upper and lower edges of the longer sides of connector shell 1, which has a basic quadrilateral configuration in its cross section, on opposite, flanking sides of the latching arms 11. As can be seen in FIGS. 2, 4, and 9 the flanges 12 extend laterally out as far as the latch arms 11 do and extend longitudinally alongside them a substantial distance (note FIGS. 1 and 9). For example, as illustrated, the flanges 12 extend back from the proximal ends 11B of the arms 11, leaving only the distal ends 11A exposed, covering about for example two-thirds of the longitudinal length of the arms 11.

The flanges 12 protect the latching arms 11 from being inadvertently struck from the sides, thereby diminishing, if not, avoiding inadvertent unlatching of the electrical connector 6 from the fuel injector 7. The latching arms 11 and flanges 12 are preferably integrally formed together with the shell body 1 from a moldable, insulating material.

As can best be seen in FIGS. 5A–6A, the secondary wedge lock member 2 has a top surface member 21 and a bottom surface member 22 with a back end 23. The top 21 includes two, side, longitudinally extending, flexible legs 24 flanking a similar, central leg 24A having on its upper side a locking protrusion or tab extension 25. The slots 26 allow the legs 24, 24A to be bent inwardly and/or upwardly (note directional arrows of FIGS. 5B and 6B), giving the legs flex.

As can best be seen in FIG. 5A, the secondary locking member 2 forms basically a "C" shape, when viewed from the side, with the legs 24 extending over the top of the female receptacles 3 and the interior legs 19A, 19B, and the bottom 22 extending under the heads 32 of the female receptacles 3 (also note corresponding directional arrows 21, 22 of FIG. 8B). The relative dimensions of the locking wedge 2, particularly in the spacing between the top and bottom extensions 21, 22, the thickness of the legs 24, and the thickness of the interfacing structure of the shell interior and the terminal heads 32 provide an additional amount of compressive force, further locking the connector elements 1, 2 and 3 together, with the interfacing interior structure of the shell 1 and the terminal heads 32 effectively being gripped between the top and bottom extensions 21, 22 and the legs 24 of the wedge lock 2 in sandwiched fashion.

Likewise, as can be seen in FIGS. 6A and 6B, the secondary locking member 2 forms basically a "T" shape, when viewed from behind, that is, from the perspective of FIG. 6A. The back side 23 thus includes a laterally extending top 23A, a centrally located, vertical stem 23B and a laterally extending, shorter base or bottom 23C.

As can best be seen in FIG. 2 and considering FIGS. 6A and 7A, the back "T" sections 23A–23C of the secondary locking member 2 along with the opposed, "L" shaped corner members 18A and 18B of the shell interior form a complete or closed, rectangular, peripheral surface divided into two laterally spaced sections by the stem 23B, thereby forming openings 74A, 74B for insertion of the male leads 71 of the fuel injector device 7. These openings in turn extend into the female openings 34 in the heads 32 of the female receptacles 3. The interfacing of the side edges of the "T" configuration 23A–C with the side edges of the opposed, "L" shaped corners 18A, 18B provides a very stable interconnection and interlock between the two, particularly in the lateral plane, centrally locating the wedge lock 2 and preventing any side wobbling between them.

Figure 3:
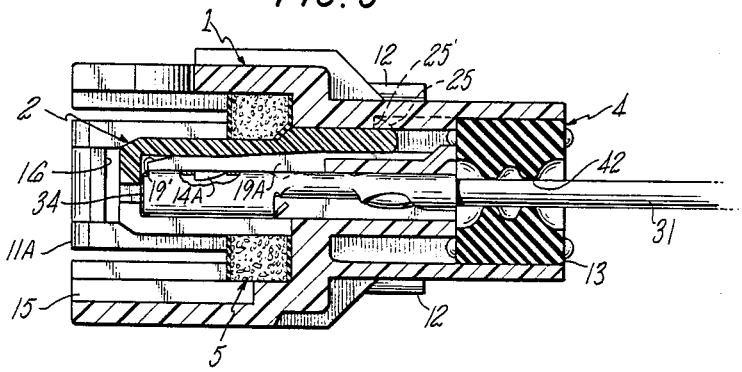

As can best be seen in FIGS. 2 and 3, the front gasket seal 5 compressively encircles the combined secondary locking member 2 and the mating interior structure of the connector shell 1, forming a liquid tight seal about them and further compressively locking them together.

The interior structure of the connector body can best be seen with reference to FIGS. 7A–8B. The specific details of the interior of the connector body 1 are designed to allow the easy insertion of the female terminals 3 into the rear end 13 of the body and the initial locking of them together, and the frontal insertion of the secondary locking member 2 into the front end 15 of the body 1, with a very stable and reliable interlock between the locking member 2 and the shell interior.

With reference to FIG. 8B, when the secondary locking member 2 is inserted into the end 15, the top surface 21 follows the path indicated by directional arrow 21, while the base portion 22 follows the line of directional arrow 22. As the secondary locking member 2 is being inserted, the central leg 24A deflects until the locking extension or protuberance 25 reaches the mating top cavity 25' (note FIG. 3), into which it then becomes lockingly engaged.

It is noted that the longitudinally, frontally extended, front extension legs 19A, 19B of the interior of the connector body 1 have a bias or bevel 19' to them on their upper sides, while the top surface 21 of the secondary locking member 2 has a bevel 21' at least on a part of its lower side, and the bottom surface 22 has beveled surfaces 22', while the legs 24, 24A have curved fronts 24', 24A'. These beveled and curved surfaces assist in the easy insertion of the secondary locking member 2 into the interior of the connector body 1 and its initial contact and initial movement over the legs 19A, 19B, the bottom interfacing structure of the shell interior and the bottom surfaces of the female lead heads 32.

As can be seen best in FIG. 3, the presence of the compressing secondary locking member 2 prevents the extension legs 19A, 19B from being moveable upwardly, preventing the tab extensions 14A, 14B from becoming disengaged from the locking openings 33, solidly and compressively locking the female receptacles 3 to the interior of the conductor body 1. This wedging action is further backed up by the compressive encirclement of the rectangular gasket 5, and the further compressive forces from the surrounding structure 76 when the connection is made up on the fuel injector 7. Thus, all these factors cooperatively work together to assure the integrity and reliability of the primary tab/opening interlock 14/33.

With respect to the terminology hereof, it is noted that the terms "top" and "bottom" are used in a relative sense with respect to the centerline of the body 1 and not in an absolute sense.

Although the invention has been shown and described with respect to a detailed embodiment thereof, it will be understood by those skilled in the art that various changes in form and detail thereof may be made without departing from the spirit and scope of the invention.

Having thus described a typical embodiment of the invention, that which is claimed as new and desired to secure by Letters Patent of the United States is:

1. An electrical connector, comprising:

a connector body having an interior, a generally open rear end and a generally open front end and having at least one forwardly extending leg in its interior having an upper surface and a lower surface;

at least one female electrical receptacle extending into said body through said rear end, said female receptacle and the lower surface of said interior extending leg of said connector body being mechanically interlocked together by means of a tab extension on one extending into a locking open area in the other; and a secondary locking member located in said front end and having a top, longitudinally extended surface extension located over said interior extending leg and a base, longitudinally extended surface extension spaced down from said top, longitudinally extended surface and located under said interior extending leg, said locking member with said top and base surface extensions forming in general a "C" shape with sad tab extension within said "C" shape, said surface extensions compressively bearing toward each other toward said interior extending leg from opposite sides, the presence of said secondary locking member preventing said tab extension from becoming disengaged out of said locking area.

2. The electrical connector of claim 1, wherein said secondary locking member includes at least one leg having a locking protrusion mating with a cooperative chamber in the interior of said connector body, interlocking said locking member to the interior of said body.

3. The electrical connector of claim 2, wherein said top surface extension forms a central, first leg and there are two additional, flanking side legs, one on each side of said top surface extension, straddling the first leg, and wherein the side legs, the central leg and said top surface extension together form the top of said secondary locking member, each said side legs being separated from said central leg by a slot allowing said side legs and said central leg to be flexed inwardly as said secondary locking member is inserted into and through the front end of said connector body.

4. An electrical connector, comprising:

a connector body having an interior, a generally open rear end and a generally open front end and having at least one forwardly extending leg in its interior having an upper surface and a lower surface;

two female electrical receptacles extending into said body through said rear end, at least one of said female receptacle and the lower surface of said interior extending leg of said connector body being mechanically interlocked together by means of a tab extension on one extending into a locking opening in the other; and a secondary locking member located in said front end and having at least one surface extension located over said interior extending leg and compressively bearing down against the surface of said interior extending leg, the presence of said secondary locking member preventing said tab extension from becoming disengaged out of said locking opening, said secondary locking member on its rearmost, exterior end forming part of the periphery of a closed, internal, peripheral surface, the remaining portion of the closed surface being provided by mating interior, peripheral extensions within the front part of the interior of said connector body, said rearmost end forming in configuration a "T", the top and base of which forms its part of said peripheral surface, the said remaining portion of said peripheral surface on the interior front of said connector body being formed by opposed, mating "L" corner shapes; said two female terminals being located in the central, laterally spaced areas located on either side of the stem of the "T" configuration and between said "L" shaped members and the balance of the "T" configuration, the "T" and the opposed "L" shapes forming two, laterally spaced rectangular openings aligned with the female openings of said terminals.

5. The electrical connector of claim 1, wherein said secondary locking member on its rearmost, exterior end forms part of the periphery of a closed, internal, peripheral surface, the remaining portion of the closed surface being provided by mating interior, peripheral extensions within the front part of the interior of said connector body.

6. An electrical connector, comprising:

a connector body having an interior, a generally open rear end and a generally open front end and having at least one forwardly extending leg in its interior having an upper surface and a lower surface;

at least one female electrical receptacle extending into said body through said rear end, said female receptacle and the lower surface of said interior extending leg of said connector body being mechanically interlocked together by means of a tab extension on one extending into a locking opening in the other; and a secondary locking member located in said front end and having at least one surface extension located over said interior extending leg and compressively bearing down against the surface of said interior extending leg, the presence of said secondary locking member preventing said tab extension from becoming disengaged out of said locking opening, said secondary locking member on its rearmost, exterior end forming part of the periphery of a closed, internal, peripheral surface, the remaining portion of the closed surface being provided by mating interior, peripheral extensions within the front part of the interior of said connector body; and a front sealing gasket extending completely around the periphery of said closed surface applying a compressive force to it, further locking said secondary locking member and the interior of said connector body together.

7. The electrical connector of claim 1, wherein there is further included at least one latching arm located on the exterior of and integrally formed with said connector body, said latching arm in its interconnection with the exterior of said connection body being flexible, said connector body having an opening adjacent to the interconnection between said latching arm and said exterior, the flexing inwardly of the latching arm at its distal end causing that portion of the connector body between said opening and its front terminus to move laterally outwardly; and wherein there is further included at least two protective, flanking flanges extending laterally out f-rom the exterior of said connector body, one on each side of said latching arm and extending longitudinally along said latching arm for a significant distance, said protective flanges reducing the potential for inadvertent contact with said latching arm from the sides thereof.

8. The electrical connector of claim 7, wherein said connector body has at least generally a longitudinally extended, quadrilateral configuration, and wherein there is included two latching arms, one on each of two opposing sides of said quadrilateral, and wherein there are a total of four protective flanges, a pair on either side flanking each latching arm.

9. The electrical connector of claim 8, wherein said quadrilateral forms a rectangle, two opposite sides being shorter than the other two opposite sides, said two latching arms being located on the shorter sides, and wherein said four protective flanges extend out from the edges of said longer sides.

10. A method of increasing the mechanical integrity of the locking engagement between a female terminal attached to a conductor wire and the interior of a connector body in an electrical connector having a connector shell, the locking engagement between the two including a mechanical locking tab extension from one extending laterally into a cooperative, comparably configured locking open area in the other, comprising the following step:

inserting a secondary locking member, having two, longitudinally extended, top and base portions, into the interior of the body of said connector shell into the end opposite from which the conductor wire to the female terminal extends from the connector shell, with the top portion extending over the locking tab extension and the base portion extending under the female terminal, holding the two on opposite sides thereof in sandwiched fashion, causing the mechanical locking tab extension and open area interface to be compressed together from both sides in a lateral direction wedging the tab extension into the locking open area, further locking them together.

11. A method of increasing the mechanical integrity of the locking engagement between a female terminal attached to a conductor wire and the interior of a connector body in an electrical connector having a connector shell, the locking engagement between the two including a mechanical tab extension from one extending laterally into a cooperative, comparably configured locking opening in the other, comprising the following step:

inserting a secondary locking member into the interior of the body of said connector shell into the end opposite from which the conductor wire to the female terminal extends from the connector shell, causing the mechanical locking tab extension and opening interface to be compressed together in a lateral direction wedging the tab extension into the locking opening, further locking them together; and inserting an encircling sealing gasket about said secondary locking member and a mating portion of the interior of the connector shell body, further compressively holding them together.

12. A method of increasing the mechanical integrity of the locking engagement between a female terminal attached to a conductor wire and the interior of a connector body in an electrical connector having a conductor shell, the locking engagement between the two including a mechanical tab extension from one extending laterally into a cooperative, comparably configured locking opening in the other, comprising the following step:

inserting a secondary locking member into the interior of the body of said connector shell into the end opposite from which the conductor wire to the female terminal extends from the connector shell, causing the mechanical locking tab extension and opening interface to be compressed together in a lateral direction wedging the tab extension into the locking opening, further locking them together; and telescopically mating the connector body with a structure surrounding a male lead of a device to which the electrical connection is being made, the structure fitting within the interior of the front end of the connector body, the interior sides of said structure compressively engaging the outer sides of said secondary locking member and a mating portion of the interior of the connector shell, further compressively holding them together.

13. An electrical connector, comprising:

a connector shell forming a connector body having an interior;

a conductor wire;

a female terminal attached to said conductor wire and being in locking engagement with said interior of said connector body, the locking engagement between the two including a mechanical tab extension from one extending laterally into a cooperative, comparably configured locking open area in the other;

a secondary locking member inserted into the interior of the body of said connector shell into the end opposite from which the conductor wire to the female terminal extends from the connector shell, causing the mechanical locking tab extension and opening interface to be compressed together in a lateral direction wedging the tab extension into the locking open area, further locking them together; and a structure surrounding a male lead of a device to which the electrical connection is being made, said connector body telescopically mating with said structure, the structure fitting within the interior of the front end of the connector body, the interior sides of said structure compressively engaging the outer sides of said secondary locking member and a mating portion of the interior of the connector shell, further compressively holding them together.

* * * * *